United States Patent [19]

Suovaniemi et al.

[11] 4,268,481

[45] May 19, 1981

[54] PIPETTE

[75] Inventors: Osmo A. Suovaniemi; Jukka Tervamäki, both of Helsinki, Finland

[73] Assignee: Kommandittiyhtio Finnpipette Osmo A. Suovaniemi, Finland

[21] Appl. No.: 129,987

[22] Filed: Mar. 13, 1980

[30] Foreign Application Priority Data

Mar. 23, 1979 [FI] Finland ..... 790992

[51] Int. Cl.[3] ..... B01L 3/02

[52] U.S. Cl. ..... 422/100; 73/425.4 P; 73/425.6; 128/765; 222/391

[58] Field of Search ..... 422/100; 73/425.6, 425.4 P; 128/218 A, 218 C, 765; 222/391, 137, 276

[56] References Cited

U.S. PATENT DOCUMENTS

| | | | |
|---|---|---|---|
| 2,523,850 | 9/1950 | Steinberg | 128/218 C |
| 2,695,023 | 11/1954 | Brown | 128/218 C |
| 3,855,868 | 12/1974 | Suovaniemi | 73/425.6 |
| 4,099,548 | 7/1978 | Sturm et al. | 73/425.6 X |

*Primary Examiner*—Arnold Turk

*Attorney, Agent, or Firm*—Hopgood, Calimafde, Kalil, Blaustein & Lieberman

[57] ABSTRACT

A pipette comprising a frame portion shaped as a handle, inside which a cylinder is formed as well as a piston fitted into the cylinder by means of a seal ring, a piston rod connected to the piston, and a press knob with shaft fitted to the upper end of the frame portion. The shaft of the press knob is fastened to the piston rod, which is by means of a seal ring guided into the cylinder space. A connecting channel passes through the piston and partly through the piston rod from the bottom end of the piston into the cylinder space. The bottom end of the piston or an extension part attached to same and provided with a through channel constitutes the tip of the pipette, to which the tip vessel is designed to be connected. When the press knob is depressed, the piston moves down and, at the same time, outwards from the cylinder space so as to suck liquid into the tip vessel by means of the vacuum in this way formed through the channel passing through the piston rod, piston, and possible extension part.

3 Claims, 1 Drawing Figure

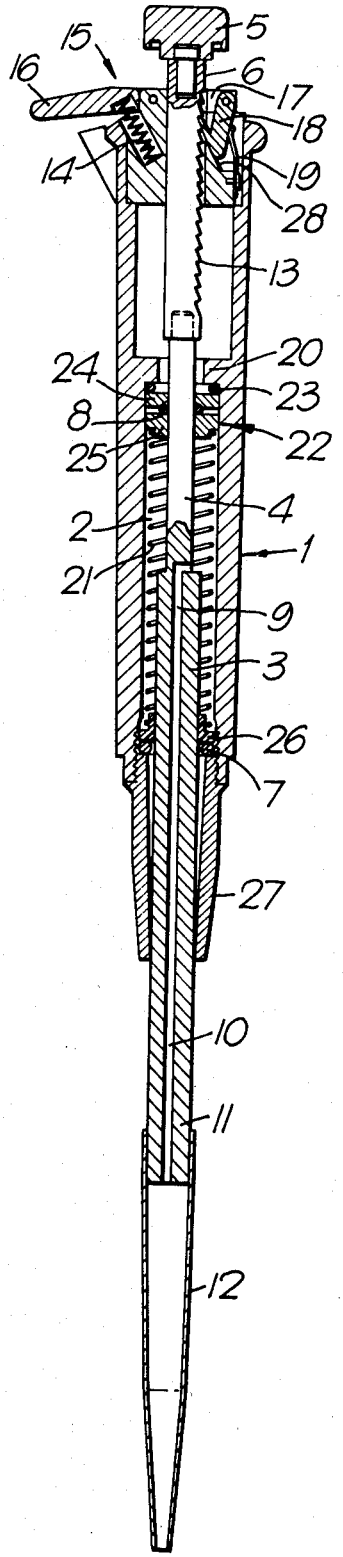
15
5
16
6
17
18
14
19
28
13
20
24
23
8
22
25
4
2
1
21
9
3
26
7
27
10
11
12

PIPETTE

The subject of the present invention is a pipette comprising a frame portion shaped as a handle, inside which a cylinder is formed as well as a piston fitted into the cylinder by means of a seal ring, a piston rod connected to the piston, and a press knob with shaft fitted to the upper end of the frame portion, and that the shaft of the press knob is fastened to the piston rod, which is by means of a seal ring guided into the cylinder space.

The object of the present invention is to provide a mechanically operating single-channel pipette of simple construction which operates by means of the hold of one hand and in which the sucking of liquid into the tip vessel takes place by depressing the press knob. In particular, it is an object of the present invention to provide a dosage pipette by means of which a portion of liqud can be taken into the disposable tip vessel and thereupon be distributed from the tip vessel as smaller doses of mutually equal magnitude one dose after the other.

The pipette in accordance with the invention is mainly characterized in that a connecting channel passes through the piston and partly through the piston rod from the bottom end of the piston into the cylinder space and that the bottom end of the piston or an extension part attached to same and provided with a through channel constitutes the tip of the pipette, to which the tip vessel is designed to be connected, whereby, when the press knob is depressed, the piston moves down and, at the same time, outwards from the cylinder space so as to suck liquid into the tip vessel by means of the vacuum in this way formed through the channel passing through the piston rod, piston, and possible extension part.

The invention comes out more closely from the following description and from the attached drawing, wherein the pipette in accordance with the invention is shown as a side view and in section.

In accordance with the FIGURE, the pipette comrpises a frame portion 1 shaped as a handle, inside which there is a cylinder 2 and a piston 3 and piston rod 4 fitted into the cylinder. In the upper part of the cylinder 2 there is an annular shoulder 20, against which a coil spring 21 presses an air-tight seal arrangement 22 between the piston rod 4 and the cylinder space 2 from underneath. The seal arrangement 22 includes a ring seal 23, which is by a ring piece 24 pressed against the bottom face of the annular shoulder 20, and a seal ring 8 fitted around the piston rod 4, which is by a counter piece 25 pressed into the seal ring 8 groove in the ring piece 24. The coil spring is pressed against the counter piece 25 by means of a counter ring 26, which belongs to the seal arrangement at the bottom end of the cylinder 2. A lower bushing 27 is connected to the bottom end of the cylinder space 2 by means of a threaded joint, the upper face of said lower bushing including a seal groove, into which a seal ring 7 is fitted around the piston 3 thereby forming an air-tight seal. By the effect of the coil spring 21, the counter ring 26 presses the seal ring 7 against the lower bushing 27.

The piston rod 4 is rigidly connected to the piston 3. The piston rod 4 shall be substantially thinner than the piston 3. To the bottom end of the piston 3, an extension part 11 is connected, to whose bottom end a disposable tip vessel 12 is designed to be connected by means of a friction joint. A connecting channel 10 and 9 passes through the extension part, piston, and partly also through the piston rod 4 and constitutes a connection from the interior space of the tip vessel 12 into the cylinder space 2. At the upper end of the frame portion 1 there is a press knob 5 with shaft 6. The shaft 6 of the press knob is at its bottom end fastened to the top end of the piston rod 4. The shaft 6 of the press knob 5 is provided with a ratchet portion 13, whose teeth are in a downward slanting position. At the upper part of the frame portion 1 of the pipette, a rocker lever 15 provided with a return spring 14 is fitted, one of whose ends constitutes a press part 16 and the other end 17 being, by means of an articulated joint, together with a hook-end hook means or catch 18, combined into a unit jointly operative with the ratchet portion 13 of the shaft 6 of the press knob 5, which hook means or catch is pressed by a spring means 19 against the ratchet portion 13.

The pipette in accordance with the present invention operates as follows.

When the press knob 5 is depressed from its upper position to its lower position, the shaft 6, the piston rod 4, the piston 3, and the extension part 11 with the tip vessel 12 move along with the knob. When the cylinder space becomes larger, a vacuum is formed in the tip vessel through the connecting channel 9, 10, whereby liquid can be sucked into the tip vessel by the effect of the vacuum through the tip of the tip vessel.

When liquid is being removed from the tip vessel, the press part 16 of the rocker lever 15 is pressed. Then the hook-end catch 18 is, as pressed by the spring 19, in contact with the diagonal toothing of the ratchet portion 13 and pulls the ratchet portion one step upwards. When the rocker lever 15 is released, the spring 14 restores it to the basic position and the hook-end catch 18 moves one step down on the ratchet portion 13. When the rocker lever 15 is depressed repeatedly, new step movements are produced on the ratchet portion 13 and thereby on the piston 3 until the piston 3 has risen to its upper position and the tip vessel 12 has been emptied. Then the tip vessel 12 can be refilled by means of the press knob 5.

In the pipette in accordance with the present invention, the tooth spacing on the ratchet portion 13 of the press knob 5 shaft determines the magnitude of the dose to be removed from the tip vessel 12 at a time.

Thus, the engagement of the hook-end catch 18 in the toothing 13 is produced by the spring means 19. The disengagement of the catch 18 from the toothing 13 when the catch 18 is in its lower position is produced by the slanting wedge face 28. The hook means 18 may also be manufactured of plastics as one piece so that the spring means 19 is incorporated in the catch construction.

Of course, within the scope of the invention, the movement may be passed from the rocker lever to another press knob, which may be placed alongside the press knob 5, in which case the dosage is, in stead of the press part 16 of the rocker lever 15, performed by means of the said second press knob.

What we claim is:

1. A pipette comprising:

a frame having an aperture at its upper portion and a cylinder at its lower portion, said cylinder including upper and lower portions;

a piston slidably mounted within said cylinder, said piston having a lower end extending out of the lower portion of said cylinder and out of the lower portion of said frame;

means for providing an air-tight seal between said piston and said cylinder at the lowermost portion of the cylinder;

a piston rod joined to an upper portion of said piston, said piston rod having a thinner cross section than the piston and extending through said aperture in said frame;

means for providing an air-tight seal between said piston rod and said cylinder;

means for manual operation of said piston rod;

a channel disposed within said piston, said channel extending along the length of the piston from an upper portion thereof and passing through its lower end coupling for fluid communication said cylinder and the surrounding atmosphere; and a vacuum being created in said cylinder when said piston is displaced downwardly by said piston rod to thereby intake fluid into said piston through said channel.

2. A pipette as claimed in claim 1, further comprising a releasably engageable tip vessel for engagement with the lower end of said piston for the intake of fluid.

3. A pipette as claimed in claim 1, further including ratchet teeth disposed on said piston rod, a rocker lever pivotably mounted to said frame proximate to said ratchet teeth, said rocker lever having a hook pivotably mounted thereto, means for biasing said hook into engagement with said ratchet teeth, said hook being displaced upwardly when said rocker lever is manually pivoted to thereby displace said piston rod upwardly to discharge fluid from said pipette.

* * * * *